US005401102A

United States Patent [19]

Faltynek et al.

[11] Patent Number: 5,401,102

[45] Date of Patent: Mar. 28, 1995

[54] BAG WITH INTERNAL PROTECTIVE FLAP

[75] Inventors: Mark Faltynek, Chicago; Morton Henshell, Park Ridge, both of Ill.

[73] Assignee: Bagcraft Corporation of America, Chicago, Ill.

[21] Appl. No.: 767,151

[22] Filed: Sep. 30, 1991

[51] Int. Cl.[6] ..... B65D 30/16

[52] U.S. Cl. ..... 383/104; 383/119; 383/120

[58] Field of Search ..... 383/93, 95, 98, 99, 383/104, 119, 120, 121, 121.1, 125, 126

[56] References Cited

U.S. PATENT DOCUMENTS

| | | | |
|---|---|---|---|
| 1,716,818 | 6/1929 | Hammond | 383/126 |
| 2,650,016 | 8/1953 | McMillan | 383/119 X |
| 3,129,848 | 4/1964 | Canno | 383/119 X |
| 3,680,445 | 8/1972 | Pearl et al. | 383/121 X |
| 3,682,372 | 8/1972 | Rodley | 383/104 |
| 4,900,163 | 2/1990 | Mack | 383/119 |

FOREIGN PATENT DOCUMENTS

| | | | |
|---|---|---|---|
| 82523 | 3/1957 | Denmark | 383/119 |
| 371989 | 10/1963 | Switzerland | 383/119 |
| 966090 | 8/1964 | United Kingdom | 383/119 |
| 2031718 | 4/1980 | United Kingdom | 383/119 |
| 2081676 | 2/1982 | United Kingdom | 383/104 |

*Primary Examiner*—Allan N. Shoap
*Assistant Examiner*—Jes F. Pascua
*Attorney, Agent, or Firm*—Hill, Steadman & Simpson

[57] ABSTRACT

There is disclosed herein a bag having front, back, gusseted side and bottom panels which includes an internal flap to cover the bag bottom, which flap is hingedly secured to one of front or back walls and adhesively secured to said bottom. The flap is movable with the bag from a folded position with the bottom lying against the back wall to an open position where the bag bottom is normal to the other walls and can be positioned flat with the flap drawn over the bottom.

8 Claims, 2 Drawing Sheets

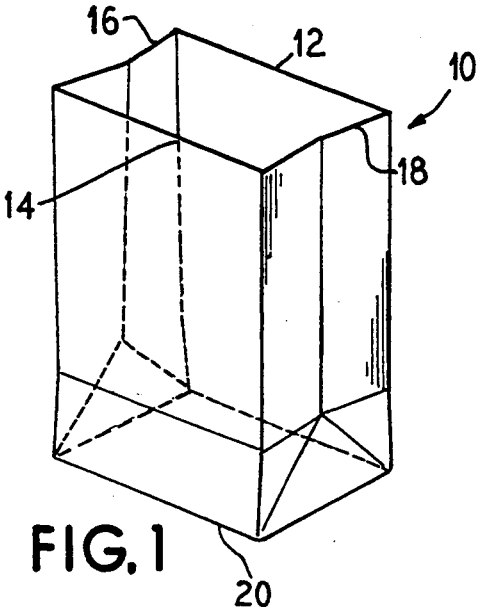
FIG. 1
FIG. 2
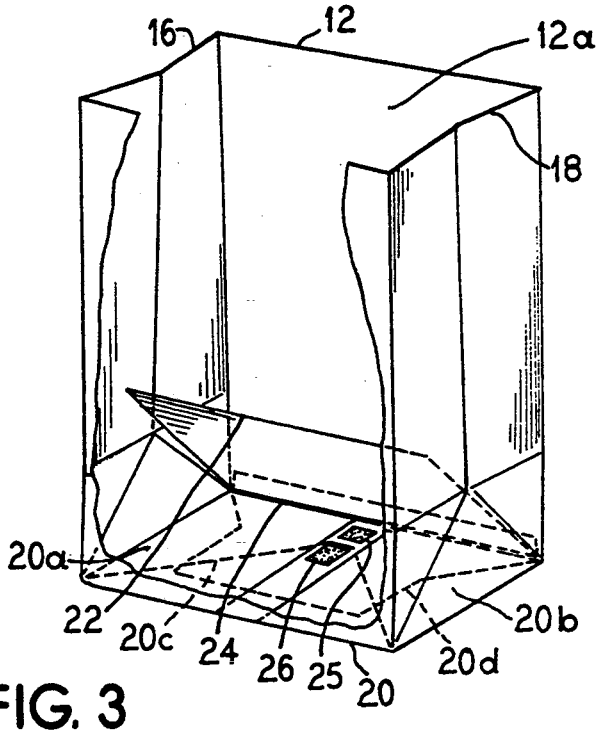
FIG. 3
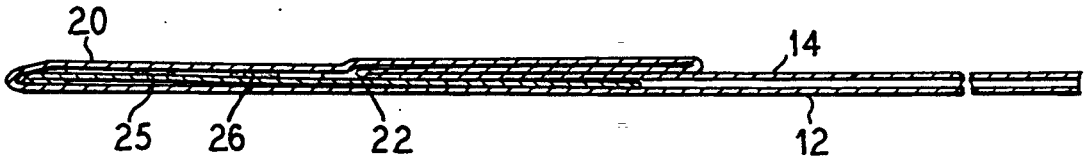
FIG. 4
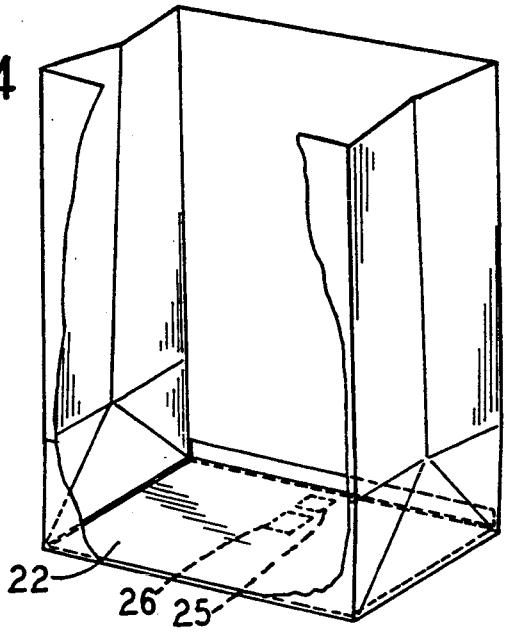

BAG WITH INTERNAL PROTECTIVE FLAP

BACKGROUND OF THE INVENTION

This invention relates to flat-bottom paper or plastic bags, and in particular, of the type which have a bottom flap to resist seepage, leakage and other types escape of bag contents.

Flat-bottom bags are used in stores to carry grocery items, in restaurants to carry fast-food-style meals, etc. Such bags can be made of paper or plastic film. Some bags have a folded and glued bottom which can exhibit leakage or seepage (by grain such as flour or liquid such as moisture and oil) and can lose their shape when loaded. Other paper bags have an external patch secured to the bottom to enhance the shape-sustaining characteristics and to reduce seepage and leakage. Finally, there are flat-bottom bags in which the bottom is heat-sealed to further minimize leakage and seepage. But these heat-sealed bags tend to be more expensive than the glue-bottom bags and do not have the desirable shape-sustaining characteristics of the external patch bags.

It is an object of this invention to provide a folded and glued flat-bottom bag which has greater leakage and seepage resistance than prior glued and folded flat-bottom bags and which exhibits shape-sustaining characteristics.

These and other objects of this invention will become apparent from the following disclosure and appended claims.

SUMMARY OF THE INVENTION

There is provided by this invention a flap

BRIEF DESCRIPTION OF THE DRAWINGS

FIG. 1 is a perspective view of a bag in general;

FIG. 2 is a perspective view of a bag as in FIG. 1 with the back panel broken away and the flap mechanism shown;

FIG. 3 is a side view showing a bag in the folded condition;

FIG. 4 is a perspective view like FIG. 2 showing the bag in the open condition with the flap in the down position;

DESCRIPTION OF THE PREFERRED EMBODIMENT

Figure 6:
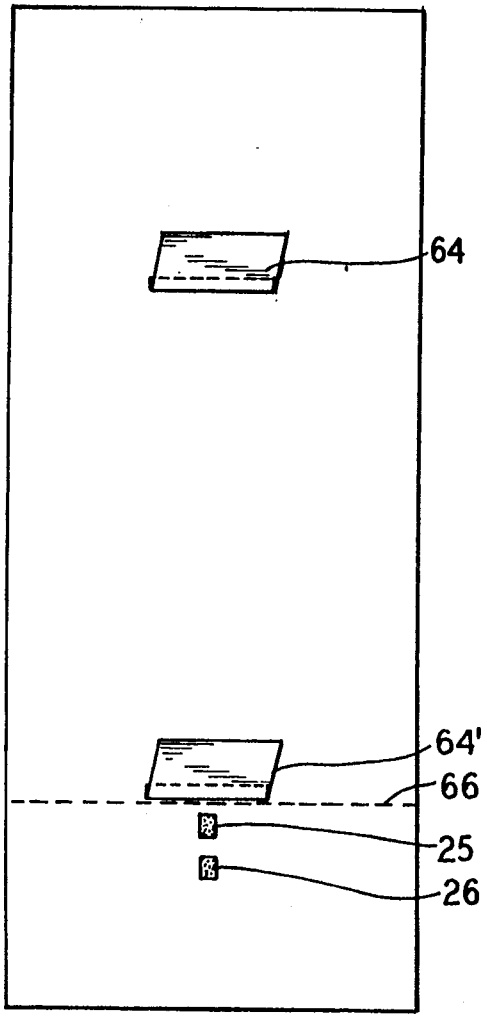
FIG. 6 is a diagrammatic view of a web for making the bag of this invention.

Referring now to the drawings and particularly FIG. 1, there is shown a bag 10 generally which includes a front panel or wall 12, a back panel or wall 14, and a pair of gusseted side panels or walls 16 and 18. The bag has a bottom 20 which is formed by folding together and then gluing the extensions of the blank that form the walls. This type of bag is known as a flat bottom or SOS bag. The manner in which such a bag is formed is known in the art.

This bag is intended to lie flat in the closed condition or storage position with the bottom against the front wall and to open into a flat position where the bottom may rest on a surface.

As indicated above, if such a bag is filled with system for folded and glued flat bottom bags. The improved system exhibits improved leakage and seepage resistance, improved shape-sustaining characteristics, and in addition, exhibits greater heat retention or temperature resistance, may be more absorbent and may exhibit increased strength.

In the system of the present invention a flat-bottom bag is provided which has an internal flap of about the same size or larger than the bag bottom. By being the same size or larger the flap tends to minimize leakage through the bag folds, increases the bag's shape-sustaining characteristics and increases the strength of the bag along the side walls. The internal flap is hingedly secured to an internal surface of one of the front or back walls. An adhesive is provided on the inner surface of the bag bottom for cooperation with the flap. In the folded position where the bag is flat, the flap engages and is secured to the adhesive, and when the bag is opened, the unfolding of the bag pulls the flap onto the bottom, thus providing the additional layer of protection. This internal flap can increase leakage and seepage protection, strengthen the bag and enhance its shape-sustaining characteristics. Moreover, the flap may be of another material such as an absorbent material or moisture barrier and have other properties, for example, being heat-sealable to the bag bottom.

In addition, it has been found to be desirable to provide the flap engaging adhesive at selected points, usually centrally located on the bag bottom for ease of manufacture.

Moreover, the bag can be manufactured by an existing bagmaking machinery with only minor modifications. an item such as flour, the same may seep from within the bag to outside the bag through the folds in the bottom.

Referring now to FIG. 2, it is seen that a similar type bag which has a front wall 12, side walls 16 and 18, and bottom wall 20 is formed. But in that bag a bottom flap panel 22 is hingedly secured, preferably by a glue, to the inside surface 12*a* of the front wall. The glue line is indicated by a line 24. The flap 22 can hinge between a position against the front wall or against the bottom.

A pair of adhesive spots such as 25 and 26 are adhered to the bottom 20 of the bag on the inside surface, usually at the center thereof.

When the bag is folded, as shown in FIG. 3, adhesive points 25 and 26 engage the flap 22 and bond to the flap. Thus as shown in FIG. 4, when the bag is opened, the flap 22 rotates downwardly to assume a position overlaying the bottom.

It is preferred that the adhesive spots 25 and 26 be centrally positioned on the bottom so as to avoid interference between the flap and the gusseted side panels when the bag is opened.

Referring now to FIG. 3, a bag 10 generally is seen in a folded position wherein the front surface 12 is positioned downwardly and the bag bottom 20 overlays the front surface. The flap 22 is seen adhered to the bottom 20 via the adhesive spots 25 and 26.

In order to open a folded bag such is done in the same manner as a standard bag in which the front wall is separated from the bag wall, the bottom flattened, and the bag is opened. When that occurs, the flap such as 22 is pulled downwardly, past the gusseted folds and overlays the bottom.

The flap 22 can be made of paper, like the bag, or it can be made of another material such as a plastic or an absorbent sponge-like material or combination of materials. In this way there is resistance to prevent the contents from seeping out of the bag, and if necessary, absorbing liquids within the bag.

The bag bottom 20 is formed by folding various extensions of the front, side and back panels and then gluing the same. The folds can be seen as rectangular side folds 20*a* and 20*b*, which extend from the side panels toward the center of the bag but are spaced from one another so as to define a pair of parallel edges running between the front and back. Next there is a triangularly shaped flap 20*c* that extends from the back panel toward the front panel and is in a sense folded over the two side flaps. The last is the bottommost flap 20*d* that extends from the front toward the back and which has a triangular shape with a squared end extension. The front and back folds when glued form the paper running along the area between the parallel lines. It can be appreciated that granular material and liquids can flow through those folds. The glue spots 25 and 26 are positioned on the back fold between the edges of the side folds.

Figure 5:
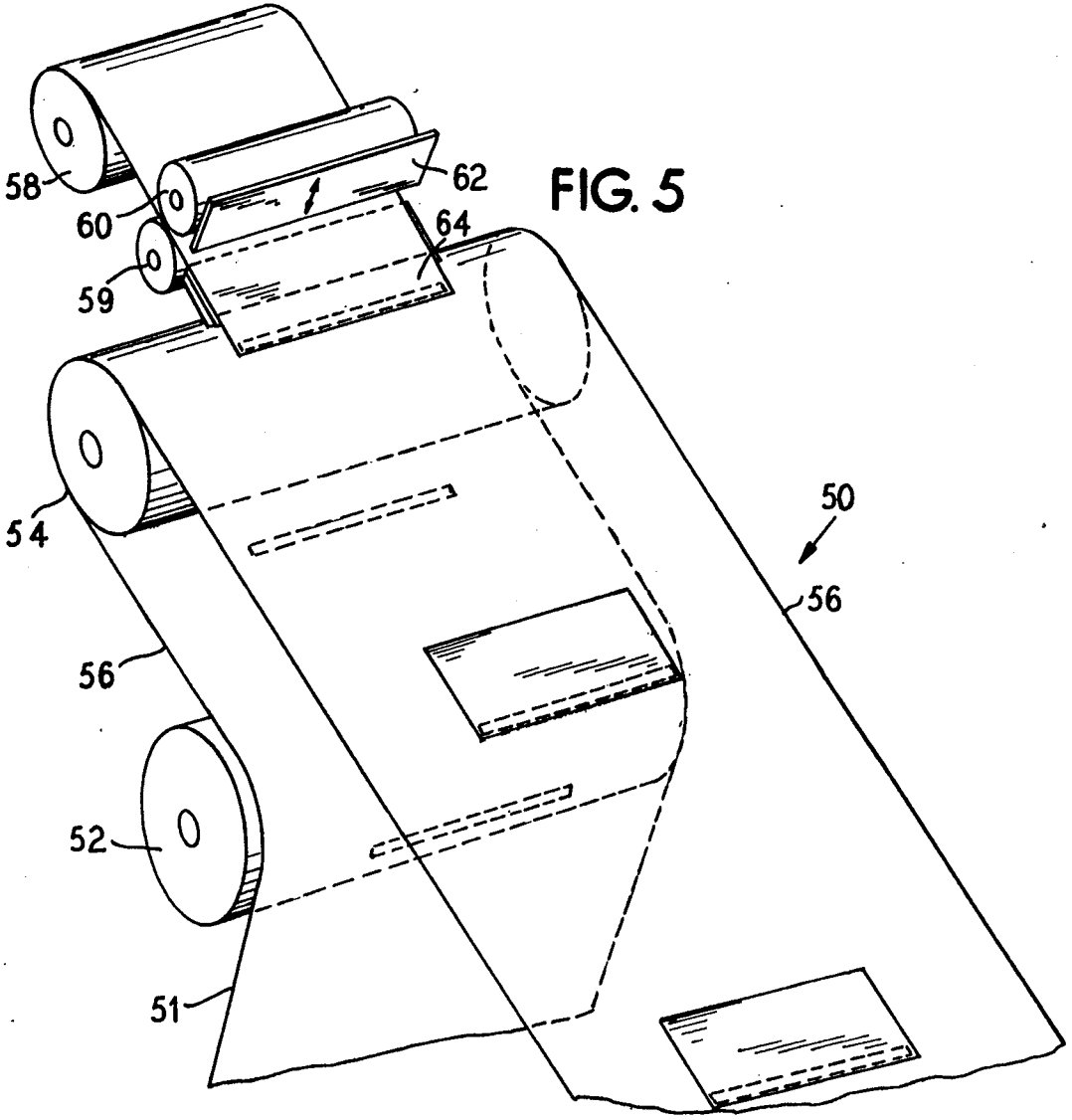
FIG. 5 is a diagrammatic view of a process for making the bag of this invention.

The bag is fabricated on standard bagmaking machinery which is suggested by FIG. 5, reference numeral 50. In such machinery a web 51 blank is paper moved by rollers such as 52 and 54 and glue is applied to the top side 56 of the web 51. Patch-applying rollers such as 58, 59 and 60 are provided adjacent the head roller and cut by a machinery such as 62 to permit the flap such as 64 to align itself with and be applied to the web 51. The bag blank is then formed from the web in the standard manner.

It is seen from FIG. 6 that the patch is applied to the web along a transverse line 66 which will become a line joining the front or back panel and bottom. The glue spots such as 25 and 26 are applied to the web centrally between the sides of the web and spaced in a direction that is upstream of the patch.

Although the invention has been described with respect to preferred embodiments, it is not to be so limited as changes and modifications can be made which are within the full intended scope of the invention as defined by the appended claims.

We claim as our invention:

1. A bag having a front panel, a back panel, a pair of gusseted side panels, each interconnecting the front and back panels, and a flat-style folded and glued bottom panel connected to the side, front and back panels and constructed to move between a folded storage position adjacent one of the front and back panels to an open position where the bottom panel is substantially normal to the back, front and side panels, wherein the improvement comprises an internal protective flap which includes a secured edge and an unsecured edge opposite the secured edge, and the secured edge is hingedly secured to an inner surface of one of said front and back panels adjacent said bottom, having a size and shape for covering said bottom and constructed to be secured to said bottom so as to be positioned adjacent said bottom panel inside said bag in the bag open position, and wherein adhesive means are provided on said bottom panel for securing said flap to said bottom panel when said bag is in the closed position and before said bag is opened.

2. A bag as in claim 1, wherein said flap is hingedly secured to said front panel so as to open toward the back panel.

3. A bag as in claim 1, wherein said adhesive means are substantially centrally positioned on said bottom panel between said side panels.

4. A bag as in claim 3, wherein said adhesive means are substantially centrally positioned on said bottom panel between said side panels and adjacent said front panel.

5. A bag as in claim 4, wherein said bottom panel includes front, back and side panel-fold extensions which extensions are folded and glued to form the bottom panel.

6. A bag as in claim 5, wherein said side extensions are folded inwardly toward one another but are spaced from each other, the back extension is folded over the side extensions and toward said front panel and the front extension is folded over the back extension toward the back and overlying panels are glued to each other.

7. A bag as in claim 1, wherein said flap is fabricated of a material which exhibits moisture absorption.

8. A bag as in claim 1, wherein said flap is formed of a material which provides a moisture barrier to prevent moisture from flowing from one side of said flap to the other.

* * * * *